United States Patent [19]

Swift

[11] Patent Number: 4,991,231

[45] Date of Patent: Feb. 12, 1991

[54] KARATE TARGET PAD

[76] Inventor: Don D. Swift, 5707 Wallwood, Knoxville, Tenn. 37912

[21] Appl. No.: 269,489

[22] Filed: Nov. 10, 1988

[51] Int. Cl.[5] ..... A41D 13/10; A63B 69/26

[52] U.S. Cl. ..... 2/18; 272/76

[58] Field of Search ..... 2/18, 16, 20, 1, 2, 161 A, 2/18, 158; 272/76, 77; 273/67 B, 55 R, 55 A; D21/210; 128/879

[56] References Cited

U.S. PATENT DOCUMENTS

| | | | |
|---|---|---|---|
| 220,281 | 10/1879 | Glover | 2/18 |
| 972,224 | 10/1910 | Pease | 2/18 |
| 2,130,200 | 9/1938 | Smith | 2/18 |
| 2,729,023 | 1/1956 | Lerner et al. | 128/879 X |
| 3,442,267 | 5/1969 | Krygier | 2/16 X |
| 3,755,820 | 9/1973 | Petrusek . | |
| 3,855,633 | 12/1974 | Rhee . | |
| 3,896,497 | 7/1975 | Rhee | 2/20 |
| 4,478,408 | 10/1984 | Brückner . | |

FOREIGN PATENT DOCUMENTS

| | | | |
|---|---|---|---|
| 951042 | 3/1964 | United Kingdom | 272/76 |

*Primary Examiner*—Werner H. Schroeder
*Assistant Examiner*—Sara M. Current
*Attorney, Agent, or Firm*—Pitts and Brittian

[57] ABSTRACT

A karate target pad for being worn on the hand and wrist is disclosed. The target pad (10) includes a resilient pad member (12) which defines a first portion (14) having a curvilinear outline preferably shaped to resemble the head of a human being, and a sleeve portion (26). The sleeve portion (26) and the first portion (14) define an opening (30) which receives the hand and wrist of a wearer. The pad is preferable provided with a cover (58) which assists in preventing the pad from tearing during use. In the preferred embodiment, the opening (30) which receives the hand and wrist is ventilated by a suitable port (56) which extends to the external surface of the pad, allows air to be received within the opening in which the hand is inserted.

7 Claims, 2 Drawing Sheets

KARATE TARGET PAD

TECHNICAL FIELD

This invention relates to a karate target pad and more particularly concerns a pad shaped to resemble a human head and which is worn over the hand and wrist during practice.

BACKGROUND ART

Protective devices used in karate practice have heretofore been known. Such devices which are designed to be worn or mounted on the hand generally include a portion which is designed to absorb a blow or thrust occasioned by a karate punch. Known prior art devices are mounted on the hand with the fingers in a bent position forming a fist or fist-like configuration. For example, see the following U.S. Pat. Nos: 3,755,820; 3,855,633; and 4,478,408.

While protective devices and gloves for practicing martial arts have heretofore been known, the karate target pad of the present invention is designed to include a resilient pad member preferably shaped to form the outline of or resemble a human head to make practice more realistic.

Another object of the present invention is to provide such a karate target pad having an opening within the pad member which receives the hand such that the fingers are extended with the palm and back of the hand and wrist protected from blows administered to the sides and front of the pad member.

Another object of the present invention is to provide such a karate target pad which is covered to assist in preventing the pad member from tearing during practice.

It is also an object of the present invention to provide such a pad having a ventilation port opening into the portion of the pad which receives the hand to provide circulation and assist in reducing hand sweat.

DISCLOSURE OF THE INVENTION

Other objects and advantages will be accomplished by the present invention which provides a karate target pad having a resilient pad member defining a first curvilinear portion and a protective sleeve portion. The pad receives the hand of a wearer, preferably in an extended position, and provides resilient padding of enhanced thickness proximate the palm and rear portion of the hand. The pad is preferably covered to assist in preventing it from being torn during karate practice. Moreover, a ventilation port is provided into the opening into which the hand is thrust to reduce sweating during use. Preferably, the first portion of the pad member is designed to resemble the outline or shape of a human head to enhance the realistic effect of karate practice.

BRIEF DESCRIPTION OF THE DRAWINGS

The above-mentioned features of the invention will be more clearly understood from the following detailed description read together with the drawings in which.

BEST MODE FOR CARRYING OUT THE INVENTION

A karate target pad constructed in accordance with various features of the present invention is described generally at 10 in FIG. 1. More specifically, the karate target pad 10 shown in FIGS. 1A–D is fabricated such that it forms, or resembles, a shape similar to that of a human head to enhance the realism of karate practice. The pad is designed to absorb punching and/or kicking blows normally occasioned on a target during training.

The karate target pad 10 includes a resilient pad member 12 fabricated from a suitable compressible material which will absorb the blow of a kick or punch. In one embodiment, this material comprises a compressed foam such as a closed cell foam. One suitable foam is Insulite (Trademark) supplied by Uniroyal.

Figure 1A:
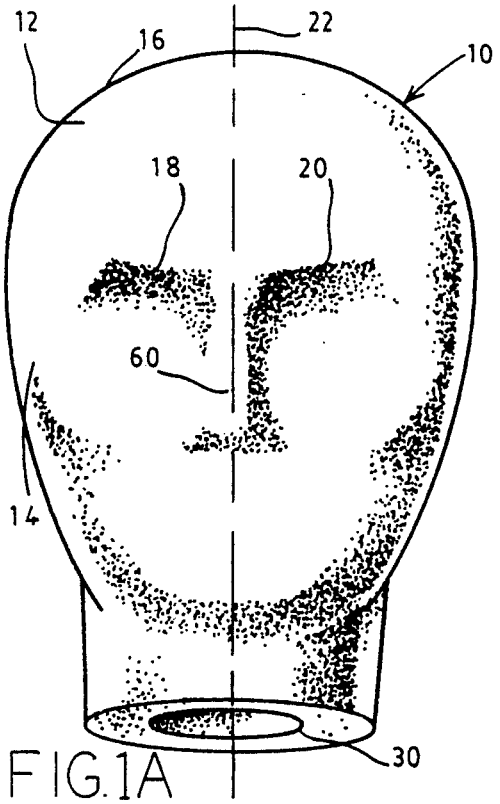
FIGS. 1A–D illustrate one embodiment of a karate target pad constructed in accordance with various features of the present invention.
Figure 1B:
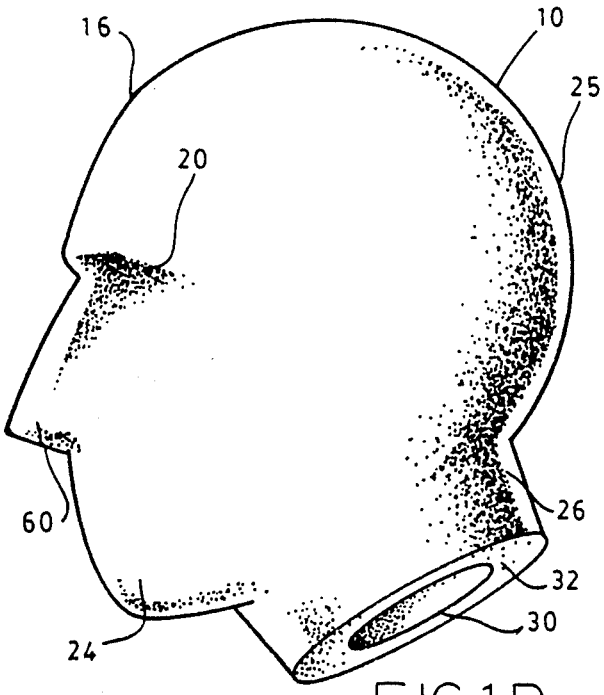
Figure 1C:
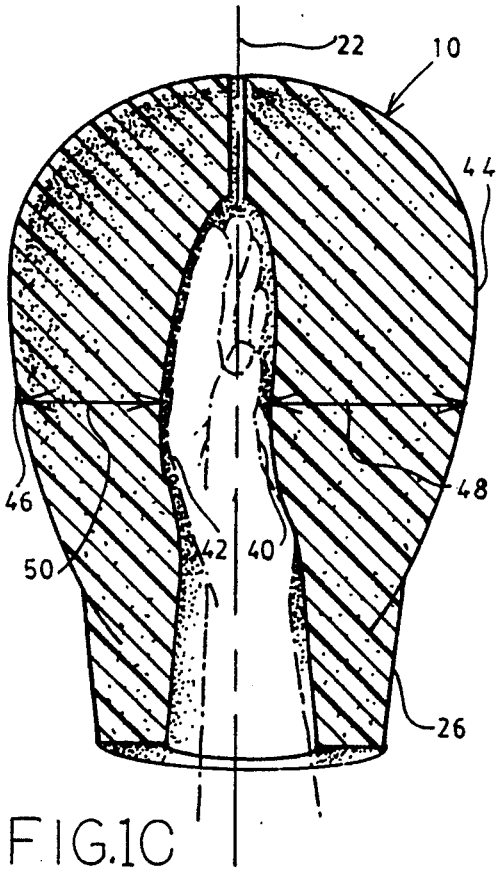
Figure 1D:
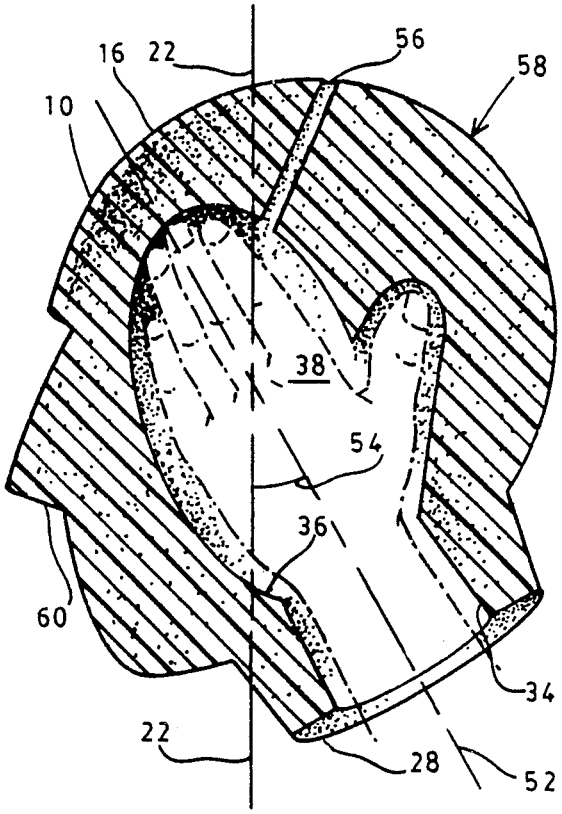

Pad member 12 includes a first portion 14 which in the embodiment depicted in FIGS. 1A, 1B and 1D defines an outer surface 16 molded or otherwise formed to have a head-like configuration. To this end, it will be noted that the outer surface 16 includes concave areas 18 and 20 simulating the eyes, a section protruding portion 60 formed generally to resemble a nose. It will be noted that the longitudinal axis of the first portion 14 of the pad member 12 is generally indicated at line 22 in FIGS. 1A, 1C and 1D.

This first portion 14 terminates proximate its lower section 24, which resembles the chin of a human head and section 25, which resembles the back of the head, in a sleeve portion 26. This sleeve portion 26 is integrally formed with the first portion 14 of the pad member 12 in the preferred embodiment, and serves to provide protection for the wrist 28 of a wearer as is illustrated in FIGS. 1C and 1D. Further, the sleeve portion is fabricated from a material similar to that from which the first portion is fabricated such that the pad member 12 can be molded or otherwise formed in its entirety in a single step. The sleeve portion 26 of the pad member 12 is dimensioned such that it resembles the neck of a human figure as is shown in figures and is tapered outwardly from its lower surface 32 to its juncture with the first portion 14.

Opening 30 is defined in the first portion 14 and the integrally formed sleeve portion 26 of the pad member 12. This opening 30 terminates as is illustrated in FIGS. 1A–B on the lower surface 32 of the sleeve portion 26. The opening 30 includes portion 34 (see FIG. 1D) extending through sleeve portion 26 of the pad member 12, and a mitten-shaped portion 36 which receives the hand 38 of a wearer. This opening 30 is preferably proportioned such that the hand 38 and wrist 28 of the wearer are positioned along, or substantially along, the longitudinal axis 22 of the pad member 12 as seen from the front or rear as is illustrated in FIG. 1C. Further, it will be noted in FIGS. 1C–D that the portion of the opening 30 in the sleeve portion 26 is tapered inwardly from the lower surface 32 to assist in holding the pad on the hand and wrist. The direction of this taper is opposite that of the outside wall of the portion 26. This feature also gives additional padding for the wrist proximate the first portion 14 of the pad which is the area most likely to be struck.

The palm 40 and back 42 of the hand 38 are positioned at preselected spaced locations from the side portions 44 and 46 of the first portion 14 of the pad member 12 as is illustrated in FIG. 1C. In this connection, a preselected thickness of compressible material can be fabricated between the opening 30 and the outer surface 16 of the pad member 12. The enhanced thickness of the compressible material between the palm 40 and back 42 of the hand 38 is demonstrated by the arrows 48 and 50, respectively. It will be recognized that with the target pad held on the hand and wrist as is illustrated in the figures, most blows will be administered to the sides 44 and 46 of the head-shaped pad member 12. With the hand in an open position, the thicknesses (about 3–6 inches) indicated by the arrows 48 and 50 of the compressible material between the outer surface 16 and the palm 40 and back 42 of a hand, respectively, serve to enhance the attenuation of the shock of a blow which ultimately reaches the hand. Further, since the blow is absorbed on the open area of the palm and back of the hand, rather than on a fist, the likelihood of injury to the hand is reduced.

It will be noted that in FIG. 1D that the longitudinal axis 52 of the opening 30 as seen from the side of the pad member 12 is positioned at an acute angle 54 with respect to the longitudinal axis 22 of the first portion 14 of the pad member 12. This acute angle generally ranges from about 30 to 60 degrees, and is preferably, approximately 45 degrees to position the hand in a manner simulating a realistic position of a head of a target during training exercises.

In accordance with another feature of the present invention, a port 56 is provided. This port 56 extends from the opening 30, or more specifically from portion 36 of the opening 30, to the outer surface 16 of the first portion 14 of the pad member 12. This port provides ventilation of the hand of a wearer positioned within the opening 30. Moreover, the port provides a ready outlet for air compressed within the opening 30 as the pad absorbs a blow from a kick or punch.

In order to assist in preventing a tearing of the pad member 12, a cover generally indicated by the thickening of the object line 58 (see FIG. 1D) is provided on the outer surface 16 of the pad 12. This cover can comprise a film of plastic or other suitable material. In one embodiment, the cover 58 is formed on the outer surface 16 of the pad 10 by a plurality of paint layers which serves to provide a smooth, durable surface on the sleeve portions of the pad. These paint layers can be formed by spray painting, or in the preferred embodiment, successively dipping the pad into a suitable paint, and allowing each layer to dry prior to the successive dip.

Figure 2A:
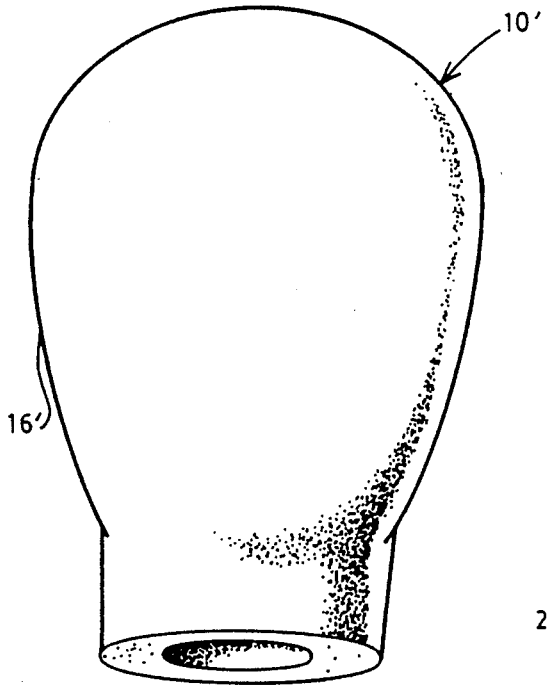
FIGS. 2A–D illustrate an alternate embodiment of the pad shown in FIGS. 1A–D.
Figure 2B:
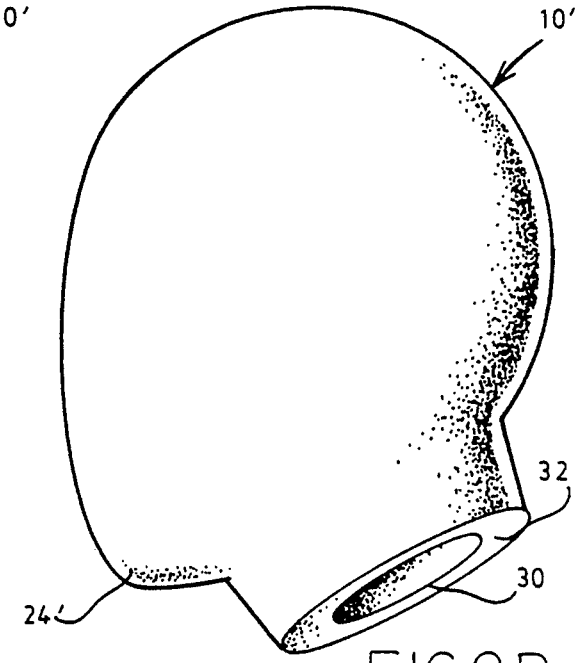
Figure 2C:
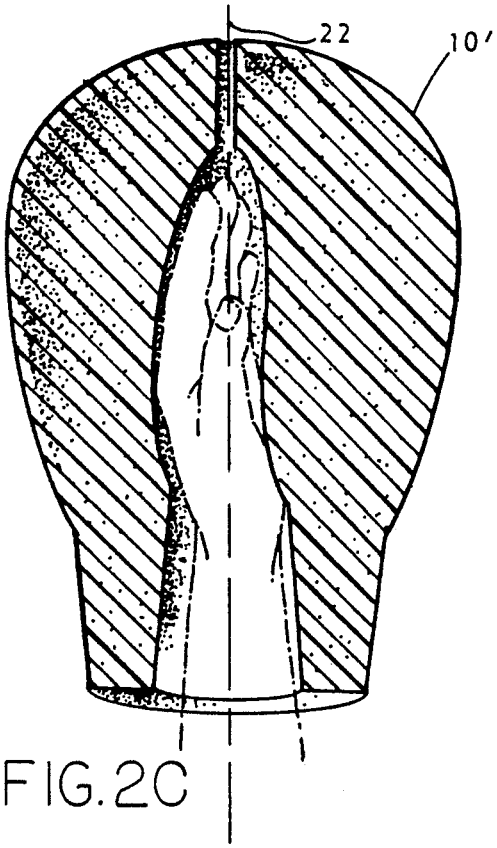
Figure 2D:
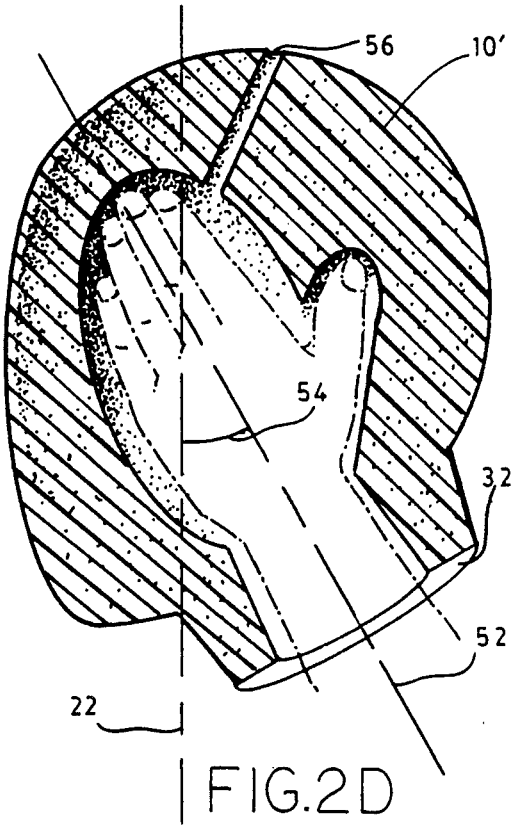

With like numerals referring to like parts, and alternate portions referred to with primed reference numerals, an alternate embodiment of the karate target pad configuration is shown in FIGS. 2A–D. More specifically, referring to FIGS. 2A–D, a pad 10' is shown which has a substantially oval form. This form, like the form shown at 10 in FIG. 1, resembles the head and neck of a human to enhance the realism of the training. However, it will be noted that the form depicted in FIGS. 2A–D is more of an oval shape without the concave sections representing the eyes or the protruding section representing the nose. Other than the external surface configuration depicted at 16', the shape and function depicted in FIGS. 2A–C are substantially similar, if not identical, to those depicted in FIGS. 1A–D.

While preferred embodiments of a karate target pad constructed in accordance with features of the present invention have been shown and described, it will be understood that there is no intent to limit the invention to such disclosure, but rather it is intended to cover all modifications and alternate construction falling within the spirit and scope of the invention as defined in the appended claims and the equivalents thereof.

I claim:

1. A karate target pad comprising:

a first portion configured to resemble a human head, said first portion having a forwardly disposed section defining facial features, said facial features including at least a pair of concaved areas provided in said forwardly disposed section to simulate eyes and a protruding portion to simulate a nose, said first portion also defining oppositely disposed first and second side sections;

a sleeve portion disposed with respect to said first portion so as to resemble a human neck;

a mitten-shaped opening provided in said pad for receiving the extended hand of a wearer, said opening extending through said sleeve portion and into said first portion, and being disposed such that as the extended hand of a wearer is received in said opening, the wearer's hand is oriented substantially perpendicular to said forwardly disposed section, with the palm of the wearer's hand facing said first side section, said opening also being aligned with respect to said pad such that when the forearm and hand of the wearer are extended at an angle of between 30 and 60 degrees relative to vertical, said head-shaped first portion is in an attitude substantially corresponding to a forwardly facing, eyes-level attitude of a human head.

2. A karate target pad comprising a resilient pad defining a first portion configured to resemble a human head, and a sleeve portion disposed with respect to said first portion so as to resemble a human neck associated therewith, said first portion having a forwardly disposed section defining at least certain human facial features, and having oppositely disposed first and second side section, said target pad being provided with an opening extending through said sleeve portion and into said first portion, said opening being mitten-shaped for receiving the extended hand of a wearer and being disposed such that as the extended hand of a wearer is received in said opening the wearer's hand is oriented substantially perpendicular to said facial section with the palm of the wearer's hand facing said first side section, said opening also being aligned within said pad such that when said head-shaped first portion is positioned in an attitude corresponding to the forwardly facing, eye-level attitude of a human head, the axis of said opening defines an acute angle relative to vertical.

3. The karate target pad of claim 2 wherein said acute angle comprises an angle between 30 and 60 degrees.

4. The karate target pad of claim 2 wherein said acute angle comprises an angle of approximately 45 degrees.

5. A karate target pad comprising a resilient pad defining a first portion configured to resemble a human head, and a sleeve portion disposed with respect to said first portion so as to resemble a human neck associated therewith, said first portion having a forwardly disposed section defining at least certain human facial features, and having oppositely disposed first and second side sections, said target pad being provided with an opening extending through said sleeve portion and into said first portion, said opening being mitten-shaped for receiving the extended hand of a wearer and being disposed such that as the extended hand of a wearer is received in said opening the wearer's hand is oriented substantially perpendicular to said facial section with the palm of the wearer's hand facing said first side section, said opening also being aligned with respect to said pad such that when the forearm and hand of the wearer are extended and at an acute angle relative to vertical, said head-shaped first portion is in an attitude substantially corresponding to the forwardly facing, eyes-level attitude of a human head.

6. The karate target pad of claim 5 wherein said acute angle comprises an angle between 30 and 60 degrees.

7. The karate target pad of claim 5 wherein said acute angle comprises an angle of approximately 45 degrees.

* * * * *